US008069881B1

(12) United States Patent
Cunha et al.

(10) Patent No.: US 8,069,881 B1
(45) Date of Patent: Dec. 6, 2011

(54) SPRING AND SPRING PROCESSING METHOD

(75) Inventors: Eugenio Ferreira Cunha, São Paulo (BR); Jason Sicotte, Bristol, CT (US); Fabio Rodrigo Geib, São Paulo (BR)

(73) Assignee: Barnes Group Inc., Bristol, CT (US)

( * ) Notice: Subject to any disclaimer, the term of this patent is extended or adjusted under 35 U.S.C. 154(b) by 0 days.

(21) Appl. No.: 12/430,582

(22) Filed: Apr. 27, 2009

Related U.S. Application Data

(63) Continuation of application No. 11/293,457, filed on Dec. 1, 2005, now abandoned.

(60) Provisional application No. 60/632,416, filed on Dec. 2, 2004.

(51) Int. Cl.
*B21F 35/00* (2006.01)
*B21F 45/00* (2006.01)

(52) U.S. Cl. ..... 140/89; 140/71 C

(58) Field of Classification Search ..... 140/71 C, 140/89, 102, 103, 135, 145; 72/371, 135, 72/145; 29/896.9, 33 F; 267/166, 167, 286
See application file for complete search history.

(56) References Cited

U.S. PATENT DOCUMENTS 3,002,865 A 10/1961 Johnson
3,751,954 A * 8/1973 Ezra et al. ..... 72/56
4,836,514 A 6/1989 Ulbing
6,811,149 B1 * 11/2004 Johnson ..... 267/167

* cited by examiner

*Primary Examiner* — Debra Sullivan
(74) *Attorney, Agent, or Firm* — Fay Sharpe LLP

(57) ABSTRACT

A method for residual stress enhancement for a coil spring includes radially expanding at least a select axial portion of the coil spring to remove residual tensile stress from the spring inner diameter and induce residual compressive stress in the spring inner diameter. The spring is expanded by radial force on the inner diameter and/or by a helical unwinding force induced by rotating at least one end of the spring relative to the other end of the spring. A tool includes a spring expansion portion and, optionally, a diameter control portion. Cylindrical, conical and/or beehive springs are processed to enhance residual stress.

4 Claims, 9 Drawing Sheets

SPRING AND SPRING PROCESSING METHOD

CROSS-REFERENCE TO RELATED APPLICATION

This application is a continuation of U.S. application Ser. No. 11/293,457 filed Dec. 1, 2005 now abandoned, which claims priority from and benefit of the filing date of U.S. provisional application Ser. No. 60/632,416 filed Dec. 2, 2004, and said application Ser. No. 11/293,457 and said provisional application Ser. No. 60/632,416 are hereby expressly incorporated by reference into this specification.

BACKGROUND

Conventionally processed helical coil springs possess a residual stress distribution that is not ideal for durability. Using known spring-coiling processes, the highly-stressed inner diameter of the resulting spring is placed in a state of residual tensile stress after coiling. Even after inducing a layer of residual compressive stress via shot-peening or otherwise, there exists a sub-surface state of residual tensile stress. This residual tensile stress is undesired and leads to excess fatigue and premature spring failure. As such, it is highly desirable to eliminate the residual tensile stress and/or to completely reverse same by imparting residual compressive stress to the spring during its manufacture or by subsequent treatment.

Back-bending by forced-arbor coiling is one example of a process used during coiling of the spring to alleviate residual tensile stress at the spring inner diameter. Post-coiling techniques for residual stress enhancement include shot-peening, piece hardening and nitriding. All of these known techniques are associated with undesired consequences such as reduced hardness, increased variation/distortion, extreme brittleness and/or greater risk of introducing defects.

The above residual stress enhancement techniques do not yield springs having sufficiently large residual compressive stress, i.e., −40 ksi (1 ksi=1000 lb/in$^2$) and below, at extended depths, i.e., deeper than 0.008", moving into the wire from which the spring is formed from the inner diameter of the spring toward the outer diameter of the spring.

With the advent of improved wire surface quality as well as improved spring manufacturing techniques, one of the most common failure modes of engine valve springs is high cycle fatigue due to the inevitable impurities in the steel. These non-metallic inclusions commonly initiate fatigue cracks after a significant number of cycles, and at a depth below the surface where compressive stress from shot-peening is either low or non-existent.

SUMMARY

In accordance with a first aspect of the present development, a method for residual stress enhancement for a coil spring comprises radially expanding at least a select axial portion of the coil spring to induce residual compressive stress at an inner diameter of the select axial portion; and, allowing the select axial portion of the coil spring to relax.

Another aspect of the present development relates to a coil spring processed by a method comprising radially expanding at least a select axial portion of the coil spring to induce residual compressive stress at an inner diameter of the select axial portion; and, allowing the select axial portion of the coil spring to relax.

In accordance with another aspect of the present development, an apparatus for enhancing residual stress in a coil spring comprises: a spring diameter control portion for surrounding an associated coil spring and for limiting radial expansion of the associated coil spring; and, a spring expansion portion adapted to engage and radially expand the associated spring into contact with the diameter control portion.

In accordance with another aspect of the present development, a residual stress enhancement method for a coil spring comprises: radially expanding the coil spring with an expansion force; removing the expansion force to relax the coil spring.

DETAILED DESCRIPTION

Figure 1:
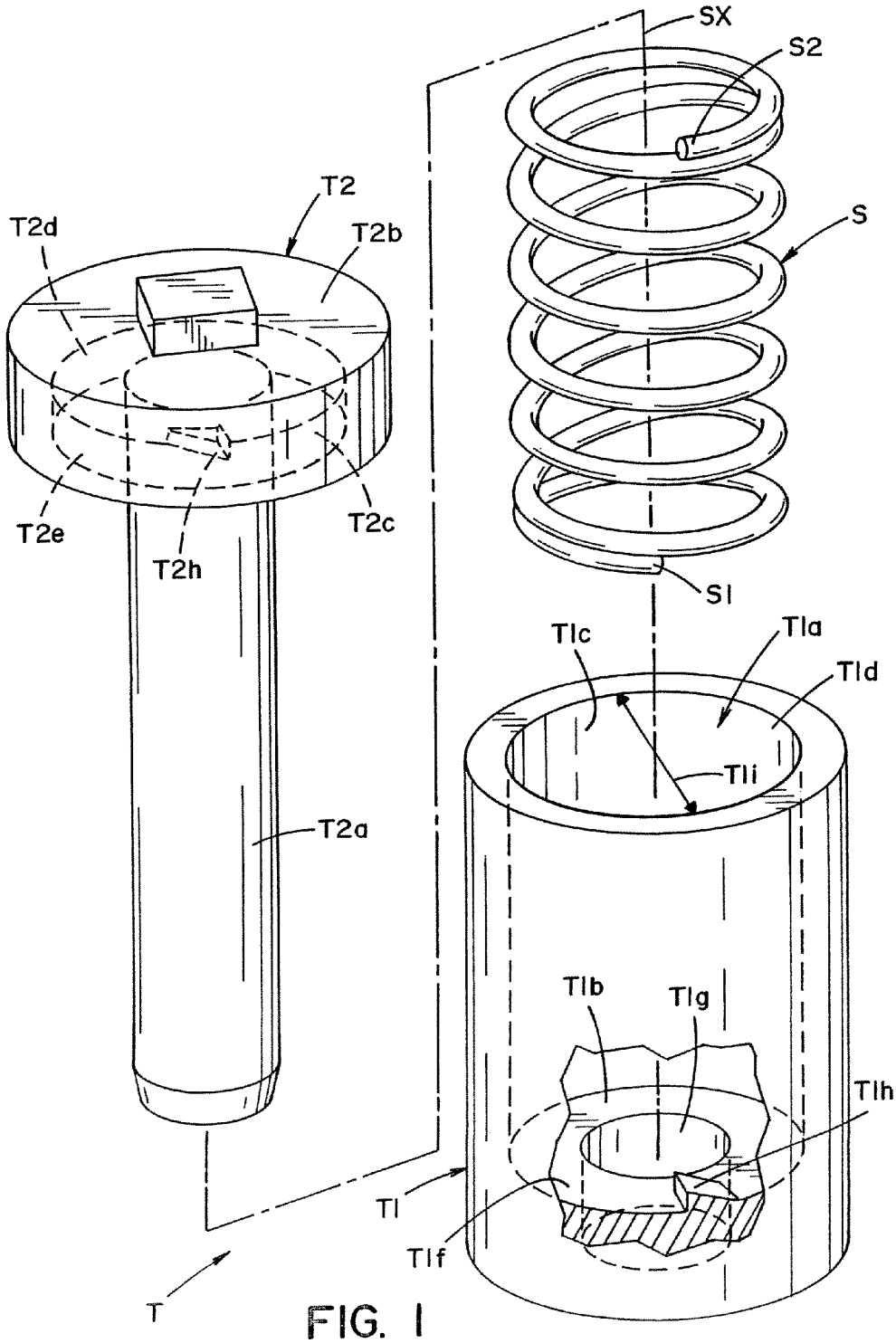
FIG. 1 is an exploded isometric illustration of a residual stress enhancement tool formed in accordance with the present development and also shows a coil spring to be processed using the tool.

FIG. 1 illustrates a coil spring S and a residual stress enhancement tool T formed in accordance with the present development. The tool T comprise a diameter control portion T1 and a spring expansion portion 12. The diameter control portion T1 comprises an expansion chamber T1*a* defined by an inner end wall T1*b* and an axially extending side wall T1*c* and an open end T1*d* located opposite the end wall T1*b*. The inner end wall T1*b* comprises an inner face T1*f* and a central aperture T1*g*. A stop-block T1*h* projects outwardly from the inner face T1*f* axially into the chamber T1*a*.

Figure 12:
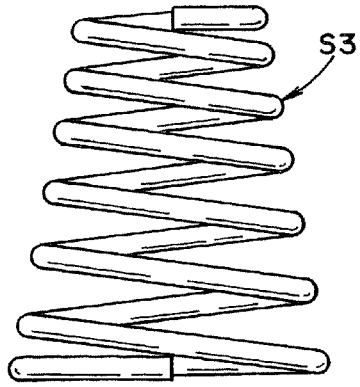
FIGS. 12 and 13 respectively illustrate conical and beehive coil springs processed in accordance with the present development.
Figure 13:
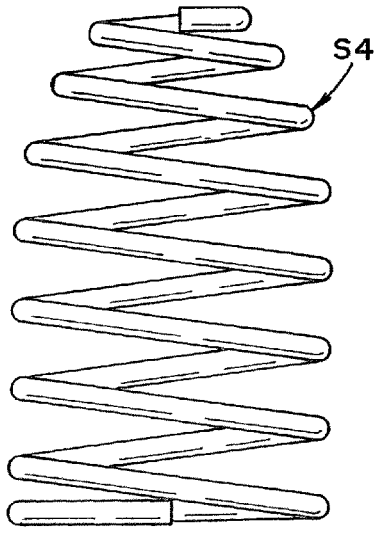

The side wall T1*c* typically defines the expansion chamber T1*a* to have an inner diameter T1*i* shaped to correspond with the shape of the spring S to be processed. For the illustrated cylindrical spring S, the expansion chamber T1*a* is cylindrical in shape. To process a conical spring S3 or beehive spring S4 (see FIGS. 12,13) the chamber T1*a* is formed with a corresponding conical or beehive shape to receive the spring S3,S4 and control expansion thereof as described herein. Spring S extends axially along a longitudinal axis SX.

Figure 2:
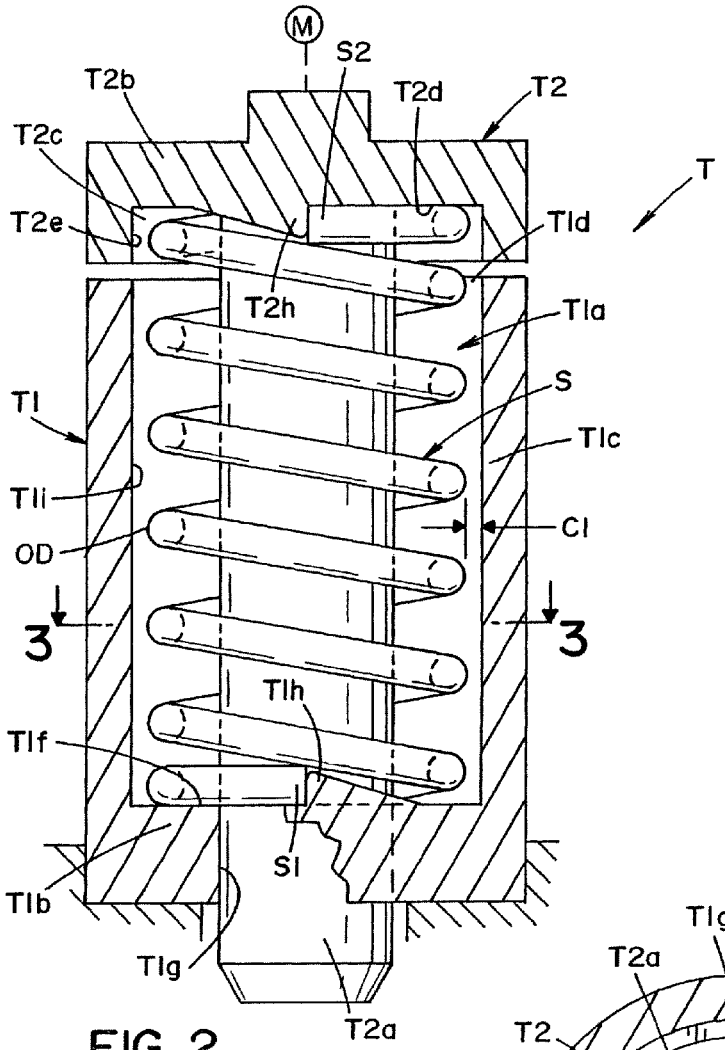
FIG. 2 shows a sectional view of the tool of FIG. 1 assembled and including the spring positioned therein, with the tool in a first operative (home) position.
Figure 3:
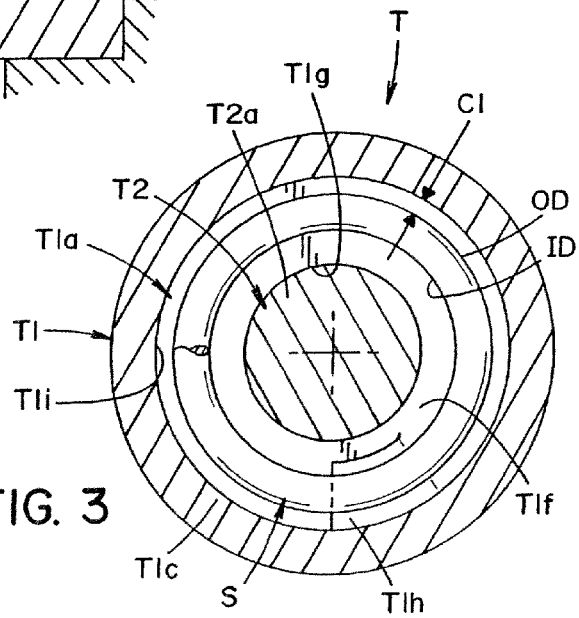
FIG. 3 is a sectional view taken along line 3-3 of FIG. 2.

FIGS. 2 and 3 show the tool T fully assembled, with the portions T1,T2 mated and the spring S located in the expansion chamber T1*a*. In FIG. 2, the tool T is in its first operative or "home" position and the spring S is in its relaxed or free state. The expansion chamber T1*a* is dimensioned to receive the spring S therein via open end T1*d* with a starting clearance C1 defined between the outer diameter OD of spring S and the inner diameter T1*i* of expansion chamber T1*a*. The spring expansion portion T2 of the tool T comprises a locator shaft T2*a* that is received through the inner diameter ID of spring S and that extends into the aperture T1*g* defined in end wall T1*b*. As such, the shaft T2*a* locates the spring expansion portion T2 of tool T relative to the diameter control portion T1 when the tool portions T1,T2 are mated as shown in FIG. 2.

The spring expansion portion T2 further comprises a cap T2*b* that defines a recess T2*c* including an inner face T2*d* and side wall T2*e*. A stop-block T2*h* projects outwardly from inner face T2*d* into recess T2*c*. In the illustrated embodiment, the sidewall T2*e* of cap recess T2*c* is shaped and dimensioned to correspond to and form and extension of the expansion chamber T1*a* of the tool portion T1 when the tool portions T1,T2 are mated. When the spring S is operatively positioned in the tool T, a first end S1 of the spring S abuts the stop-block T1*h* (or will abut same upon rotation) and the opposite second end S2 of spring S abuts the stop-block T2*h* (or will abut same upon rotation of tool portion T2).

Figure 4:
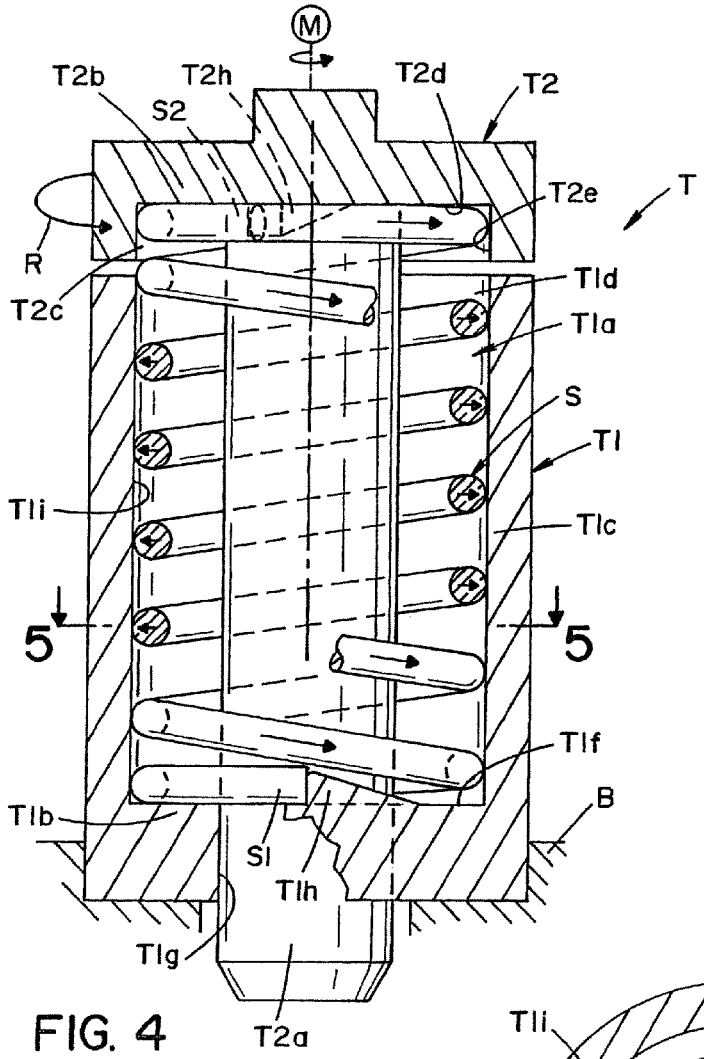
FIG. 4 illustrates the tool and spring of FIGS. 1 and 2 in a second operative position.
Figure 5:
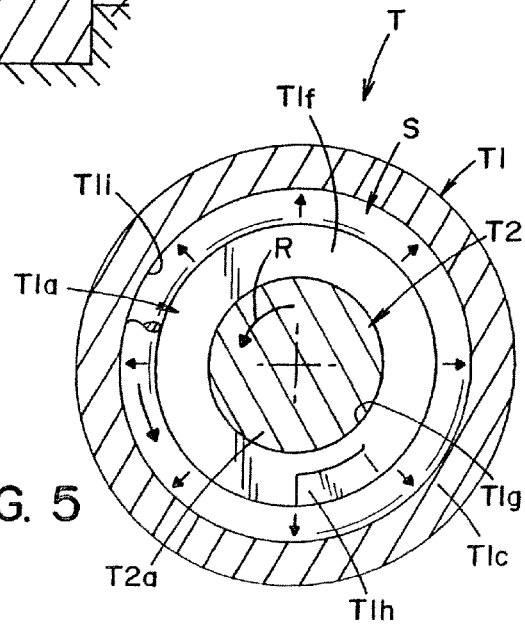
FIG. 5 is a sectional view as taken along line 5-5 of FIG. 4.

FIGS. 4 and 5 correspond respectively to FIGS. 2 and 3 but show the tool T in a second operative state when the spring expansion portion T2 is activated to expand the spring S radially within the expansion chamber T1*a*, preferably a maximum possible amount, as limited only by the inner diameter T1*i* of the chamber T1*a*. In the illustrated embodiment, the spring S is expanded by relative rotation R between the tool portions T1,T2 while preventing axial separation of same so that the spring S is expanded or "unwound" owing to the oppositely oriented forces exerted on the spring ends S1,S2 by the stop-blocks T1*h*,T2*h*, respectively, urging the spring ends S1,S2 in opposite directions against each other which results in opposed helical forces in the spring S, which leads to radial expansion of the spring S. As shown in FIG. 4, the relative rotation between the tool portions T1,T2 is provided by a motor M such as a servo-motor that is operatively coupled to the second tool portion T2 while the first tool portion T1 is restrained against rotation by a base B. The motor M also prevents axial separation of the tool components T1,T2 during expansion of the spring S, and/or separate means for axially fixing the tool portions T1,T2 relative to each other can be provided. Alternatively, both tool portions T1,T2 can be rotated by respective motors or other means in opposite directions relative to each other. In another alternative embodiment, either or both tool portions T1,T2 are manually rotated relative too each other and manually restrained against axial separation. After the spring S is expanded, the unwinding force is removed and the spring S is allowed to relax and return to a free state as shown in FIGS. 6 and 7.

Figure 6:
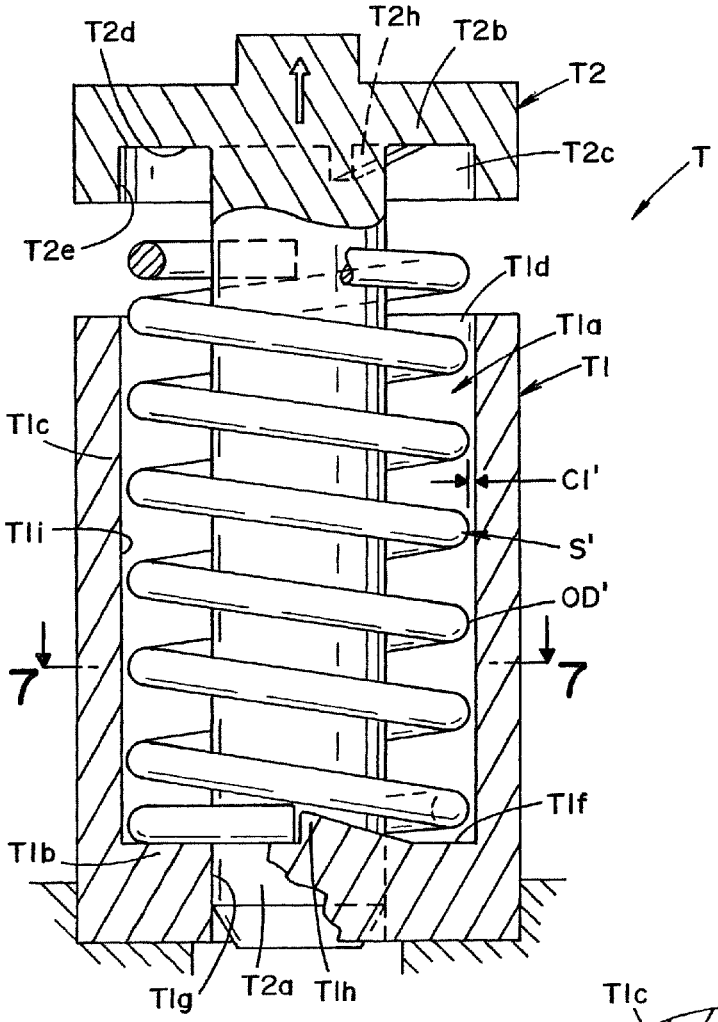
FIG. 6 shows the tool and spring of FIGS. 1 and 2 after processing and during separation of the tool components.
Figure 7:
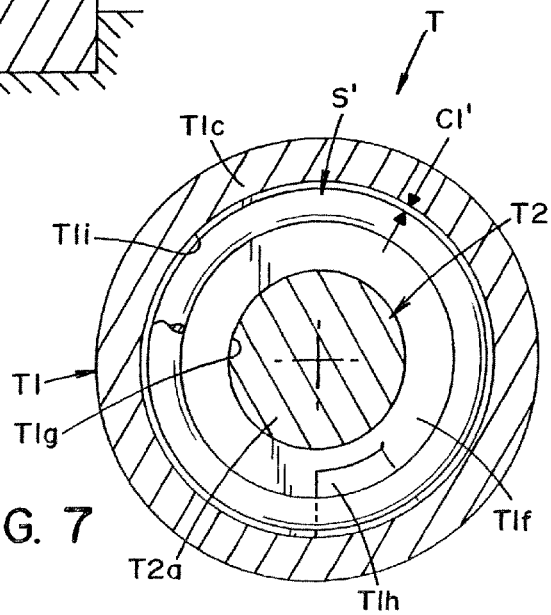
FIG. 7 is a sectional view taken along line 7-7 of FIG. 6.

FIGS. 6 and 7 correspond respectively to FIGS. 4 and 5 but show the tool T in a partially disassembled state where the portion T2 is partially axially separated from the portion T2 (when the tool portion T2 is fully separated from the tool portion T1, the spring is removed from the chamber T1*a* via open end T1*d*). The spring has been processed in accordance with the present development and has returned to a free state and, thus, is designated S' in FIGS. 6 and 7. The spring S' has an outer diameter OD' that is somewhat larger then the initial outer diameter OD of the unprocessed spring S and, thus, a final clearance C1' is defined between the outer diameter OD' and the inner diameter T1*i* of chamber T1*a*, and the final clearance C1' is smaller than the starting clearance C1.

Figure 8:
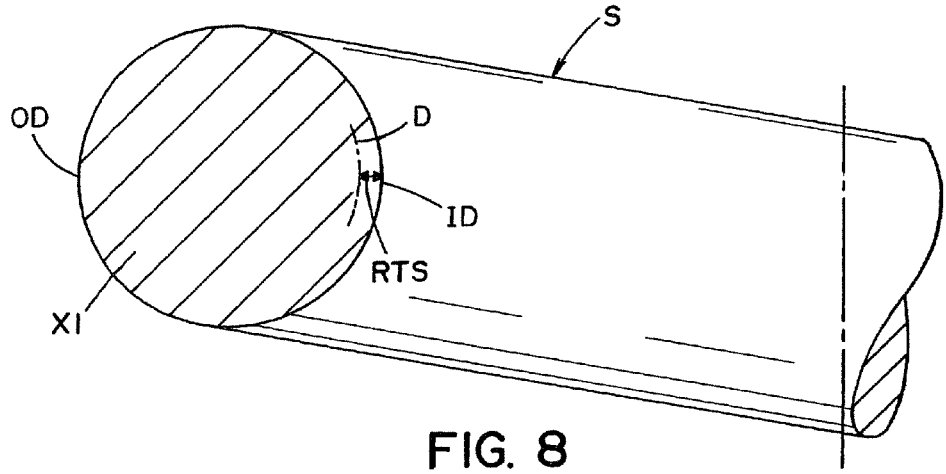
FIG. 8 illustrates a section of the wire from which the spring of FIG. 1 is formed prior to processing in accordance with the present development and diagrammatically shows the undesired residual tensile stress therein.
Figure 9:
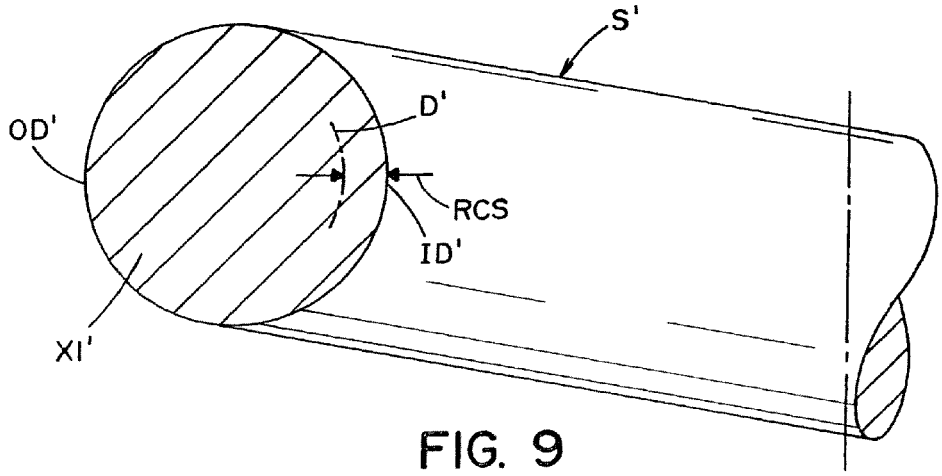
FIG. 9 shows the section of wire of FIG. 8 subsequent to processing according to the present development and diagrammatically shows the resulting residual compressive stress.

FIG. 8 shows a section X1 of an unprocessed spring S wherein the inner diameter ID of the spring S exhibits residual tensile stress to a depth D as indicated by the arrow RTS. FIG. 9 shows a section X1' of a spring S' after processing in accordance with the present development. The inner diameter ID' of the spring S' exhibits residual compressive stress indicated by arrow RCS to a depth D'.

Figure 10:
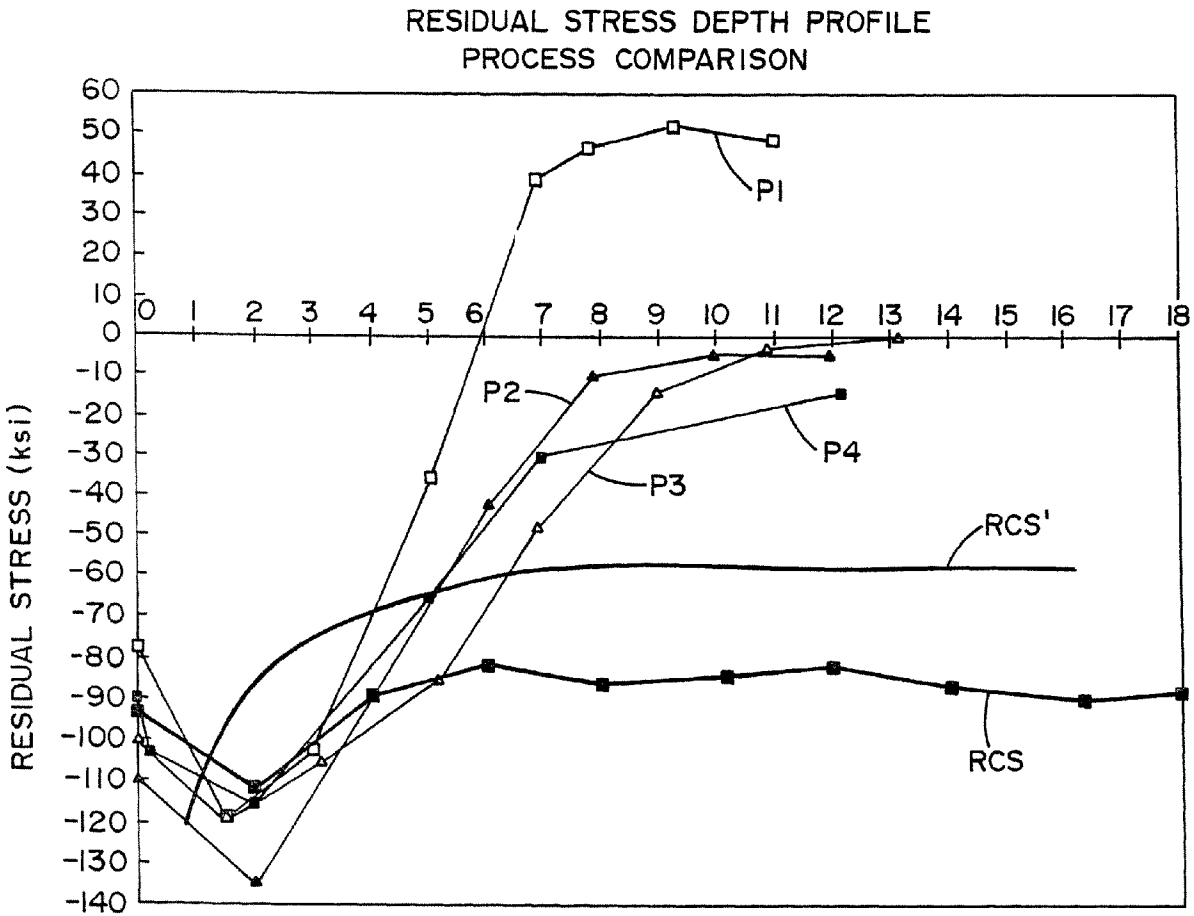
FIG. 10 graphically illustrates the residual stress profiles attainable using four prior art enhancement methods and the method and apparatus of the present development.

FIG. 10 graphically illustrates the residual compressive stress RCS of FIG. 9 as compared to four prior art methods P1-P4; pretempered (e.g., CrSi) P1, piece-hardened P2, nitriding P3, and forced arbor P4. There, it can be seen that the prior art methods provide sufficient residual compressive stress (−40 ksi or below) to a maximum depth of only about 0.008" or less. A spring S' processed according to the present development shows sufficient residual compressive stress at a depth D' of about 0.018" as indicated by the line RCS. The line RCS' shows a combination of the present development and a subsequent shot-peening process (e.g., micro-peening) which also indicates favorable results. It should be noted by those of ordinary skill in the art that any of the lines P1,P2, P3,P4 can be "pulled down" to satisfactory stress levels by subsequent processing in accordance with the present development, i.e., the results of prior art methods can be enhanced by subsequent processing in accordance with the present development.

Figure 11:
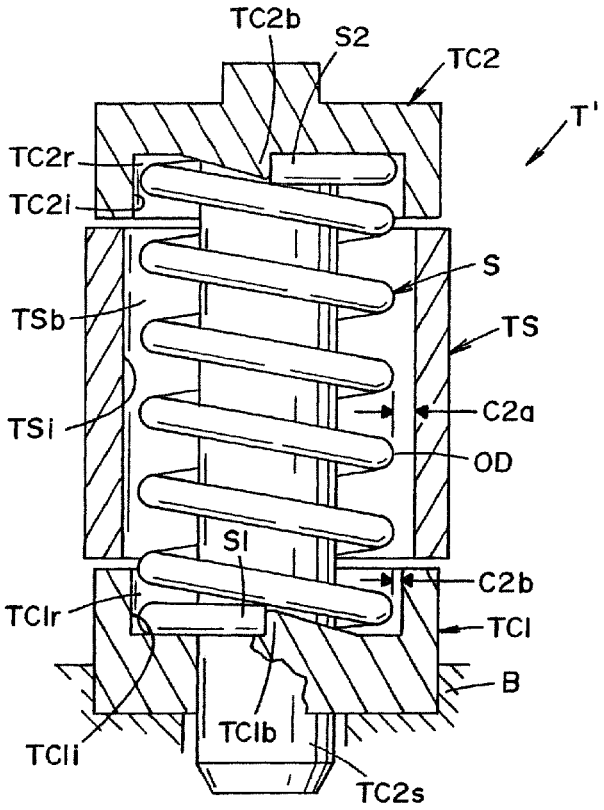
FIG. 11 illustrates an alternative varying-diameter tool formed in accordance with the present development for selective application of residual stress enhancement.

FIG. 11 illustrates an alternative tool T' usable for performing residual stress enhancement according to the present development. The tool T' comprises first and second end caps TC1,TC2 defining respective recesses TC1*r*,TC2*r* including stop-blocks TC1*b*,TC2*b* for abutting the spring ends S1,S2 as shown. The second cap TC2 comprises a locator shaft TC2*s* that projects axially outwardly there from and that is received into an aperture TC1*r* of the cap TC1. The tool T' further comprises a central diameter control sleeve TS. The sleeve TS defines a through-bore TSb that is shaped to correspond to the outer diameter of the spring S. As shown the bore TSb is cylindrical. The bore TSb of sleeve TS has a different (larger in the illustrated embodiment) inner diameter TSi as compared to the inner diameters TC1*i*,TC2*i* of the recesses TC1*r*, TC2*r* (the diameters TC1*i*,TC2*i* can be identical or different from each other). As such, a first initial radial clearance C2*a* is defined between the outer diameter OD of spring S and the inner diameter TSi of sleeve TS, while a second initial radial clearance C2*b*, different from the first initial clearance C2*a*, is defined between the outer diameter OD of spring S and the inner diameters TC1*i*,TC2*i* of recesses TC1*r*,TC2*r*. Upon radial expansion of spring S within tool T' by relative rotation of the first and second end caps TC1,TC2, the portion of spring S surrounded by the sleeve TS will expand more than the portion of the spring S located within the recesses TC1*r*, TC2*r* of end caps TC1,TC2. As such, the residual stress profile of the processed spring S' will vary along its axial length as is desired for certain applications. It should be noted that the tool T' can alternatively be configured to prevent any expansion of a certain axial portion of the spring S.

Figure 11A:
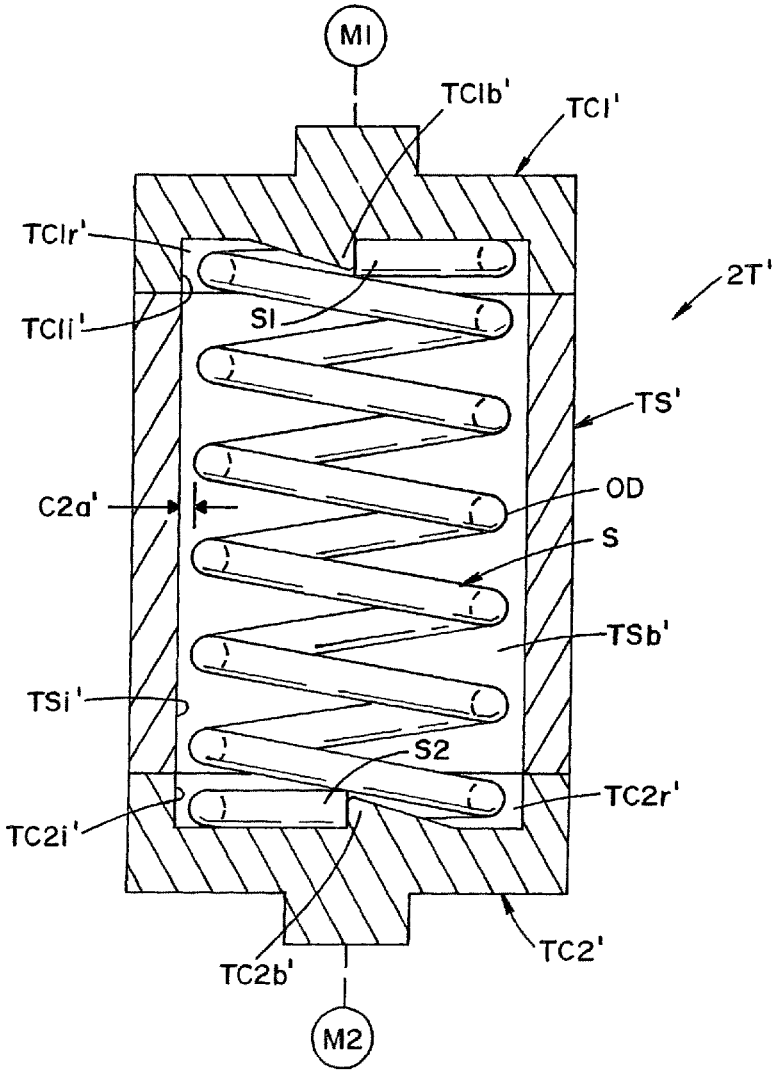
FIG. 11A shows another alternative spring expansion tool formed in accordance with the present development.

FIG. 11A shows another alternative tool 2T' comprising first and second end caps TC1',TC2' defining respective recesses TC1*r*',TC2*r*' including stop-blocks TC1*b*',TC2*b*' for abutting the spring ends S1,S2 of a coil spring S as shown. The tool 2T' further comprises a central diameter control sleeve TS'. The sleeve TS' defines a through-bore TSb' that is shaped to correspond to the outer diameter of the spring S. As shown the bore TSb' is cylindrical. As shown, the bore TSb' of sleeve TS' has the same inner diameter TSi' as compared to the inner diameters TC1*i*',TC2*i*' of the cap recesses TC1*r*,TC2*r* (the diameters TC1*i*',TC2*i*' can be identical or different from each other), but the inner diameter TSi' of the sleeve bore TSb' can be larger or smaller than the cap inner diameters TC1*i*', TC2*i*' to vary radial expansion of the spring along its axial length if desired. A radial clearance C2*a*' is defined between the outer diameter OD of spring S and the inner diameter TSi' of sleeve TS' and between the spring outer diameter OD and the cap inner diameters TC1*i*',TC2*i*'. First and second servo-motors M1,M2 or other manual or powered means are respectively engaged with the end caps TC1',TC2' and are adapted to rotate the end caps TC1',TC2' in opposite directions to radially expand the spring S into contact with the sleeve TS' as described above. The caps TC1',TC2' are shown in axial abutment with the sleeve TS' (but need not be) and are maintained in abutment with the sleeve during the spring expansion operation to prevent axial elongation of the spring during expansion.

Figure 14:
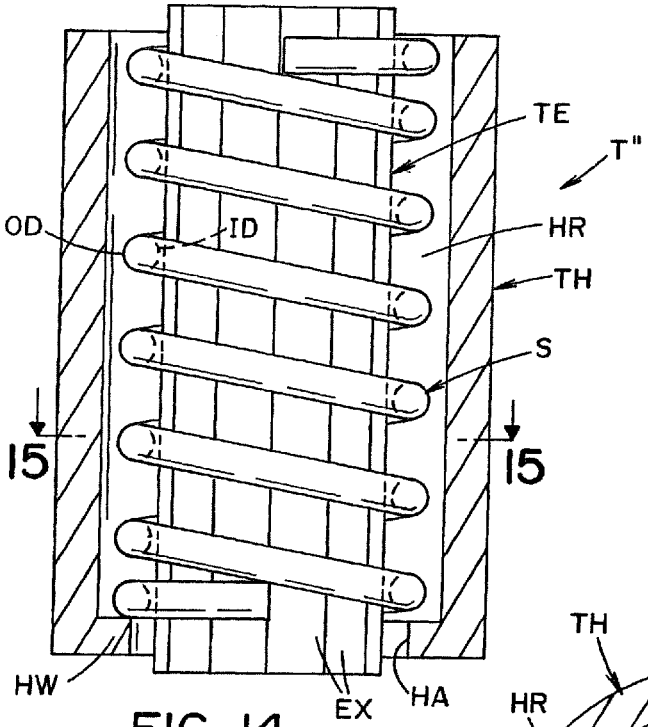
FIG. 14 illustrates another alternative tool for residual stress enhancement formed in accordance with the present development in its first operative state.
Figure 15:
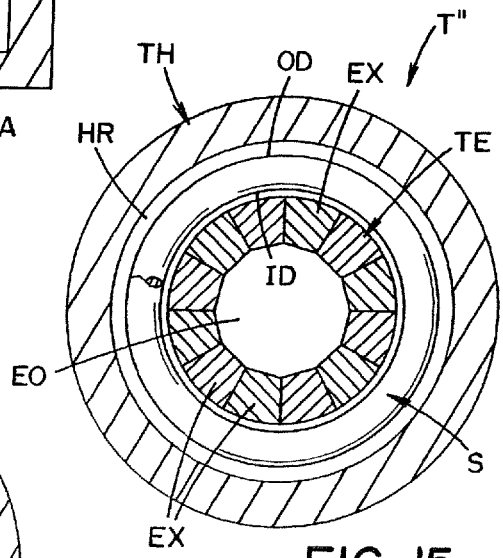
FIG. 15 is a sectional view taken along line 15-15 of FIG. 14.
Figure 16:
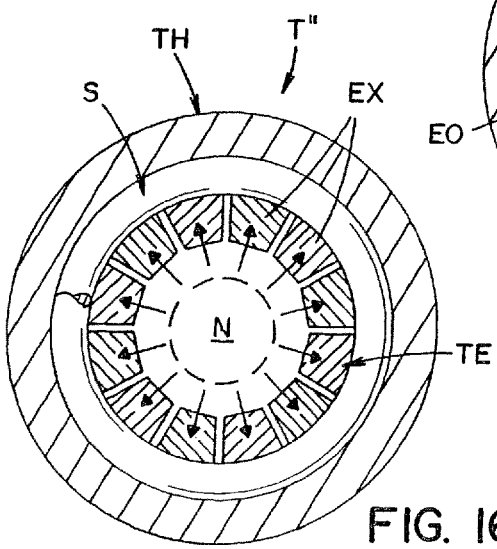
FIG. 16 is similar to FIG. 15 but shows the tool of FIG. 14 in its second operative state.

FIG. 14 shows another alternative tool T" comprising a diameter control housing TH and an expansion tool TE. The housing TH defines a cup-like recess HR into which the spring S is loosely received. The expansion tool TE is received within the inner diameter ID of spring S and projects through an aperture HA defined in an end wall HW of the housing TH. As shown in FIG. 15, the expansion tool TE comprises a plurality of circumferentially adjacent sections EX that cooperate to define an annular member having a central opening EO. To expand the spring S, a mandrel N or other member (FIG. 16) is inserted axially into the opening EO of the expansion tool TE and is used to urge the sections EX thereof radially outward as shown in FIG. 16 so that the sections EX engage the spring S and radial expand same into abutment with the housing TH (the housing TH can be omitted if expansion is controlled/limited by the expansion tool TE). The expansion tool TE is then contracted and removed so that the processed spring S' exhibiting the desired residual compressive stress profile RCS can be relaxed and removed from the housing TH.

A spring S can be processed in accordance with the present development at an elevated temperature as compared to ambient conditions, such as, e.g., 450° C. In such case, the spring S is heated to the desired elevated temperature, expanded, and then cooled. This method is particularly suitable for enhancing very high hardness piece hardened or nitrided springs.

Additionally, the process of the present development can be performed at artificially reduced temperatures as compared to ambient conditions to induce greater stress levels in lower hardness springs, e.g., using liquid nitrogen.

The process is not to be limited to any specific spring material and can be used for any known spring material, including pretempered and Chrome-Silicon (CrSi) based alloys.

Those of ordinary skill in the art will recognize that the present spring processing development can be used before and/or after other spring processing methods such as shot-peening (including micro-peening), nitriding, piece-hardening, etc. Owing to the greater compressive residual stress below the shot-peen-affected zone, the present invention will act to extend fatigue life of engine valve springs by slowing the initiation and propagation of fatigue cracks around the inclusions.

The invention has been described with reference to preferred embodiments. Modifications and alterations will occur to those of ordinary skill in the art upon reading this specification. It is intended that the claims be construed as including all such modifications and alterations to the fullest possible extent.

The invention claimed is:

1. A residual stress enhancement method for a coil spring, said method comprising:

radially expanding a coil spring, said coil spring including an inner diameter portion exhibiting residual tensile stress and an outer diameter portion, said step of radially expanding said coil spring comprising using an expansion force such that said outer diameter portion is expanded radially from an initial size to an expanded size; and, removing the expansion force from the spring such that the spring relaxes and becomes a processed spring comprising said inner diameter portion and said outer diameter portion, wherein said outer diameter portion of said processed spring defines a final size that is dimensioned between said initial size and said expanded size and said inner diameter portion of the processed spring comprises residual compressive stress.

2. The residual stress enhancement method as set forth in claim 1, wherein said expansion force comprises a rotational force applied to at least one of first and second ends of the coil spring.

3. The residual stress enhancement method as set forth in claim 1, wherein said expansion force comprises a radial force imposed on said inner diameter portion of the coil spring.

4. The residual stress enhancement method as set forth in claim 1, wherein said method further comprises:

before said step of radially expanding said coil spring, positioning the coil spring in an expansion apparatus that comprises a structure for limiting the radial expansion of said coil spring by contact with said outer diameter portion of said spring.

* * * * *